United States Patent [19]

Gelfer et al.

[11] Patent Number: 4,908,768

[45] Date of Patent: Mar. 13, 1990

[54] INSERTER BASED MAIL MANIFESTING SYSTEM

[75] Inventors: George G. Gelfer, West Redding; William G. Hart, Jr., Stamford, both of Conn.

[73] Assignee: Pitney Bowes Inc., Stamford, Conn.

[21] Appl. No.: 82,699

[22] Filed: Aug. 7, 1987

[51] Int. Cl.[4] ..... G07B 17/02

[52] U.S. Cl. ..... 364/464.03; 209/584; 209/900; 235/375; 364/478

[58] Field of Search ..... 53/266 A; 209/584, 900; 198/505; 235/375; 364/464, 466, 478, 464.03

[56] References Cited

U.S. PATENT DOCUMENTS

| | | | |
|---|---|---|---|
| 3,757,942 | 9/1973 | Gunn | 209/584 X |
| 3,904,946 | 9/1975 | Dlugos et al. | 198/505 X |
| 3,935,429 | 1/1976 | Branecky et al. | 235/454 |
| 4,167,476 | 9/1979 | Jackson | 209/900 X |
| 4,495,581 | 1/1985 | Piccione | 177/25.15 X |
| 4,507,739 | 3/1985 | Haruki et al. | 209/584 X |
| 4,511,793 | 4/1985 | Racanelli | 364/466 X |
| 4,568,072 | 2/1986 | Piotroski | 235/375 X |
| 4,639,873 | 1/1987 | Baggarly et al. | 364/466 |
| 4,649,691 | 3/1987 | Buckholz | 53/266 A X |
| 4,734,865 | 3/1988 | Scullion et al. | 364/478 |
| 4,760,532 | 7/1988 | Sansone et al. | 364/464.03 |
| 4,760,534 | 7/1988 | Fougere et al. | 364/464.03 X |
| 4,800,505 | 1/1989 | Axelrod et al. | 209/584 X |
| 4,829,443 | 5/1989 | Pintsov et al. | 364/478 X |

OTHER PUBLICATIONS

Pitney Bowes publication on "Computerized Parcel Shipping System", pre Jul. 1984.

*Primary Examiner*—Parshotam S. Lall
*Assistant Examiner*—Edward R. Cosimano
*Attorney, Agent, or Firm*—Donald P. Walker; Melvin J. Scolnick; David E. Pitchenik

[57] ABSTRACT

An inserter based mail manifesting system includes a controller that processes sensed information and generates a manifest that can accompany mail to a postal depository.

14 Claims, 2 Drawing Sheets

INSERTER BASED MAIL MANIFESTING SYSTEM

BACKGROUND OF THE INVENTION

The present invention generally relates to an inserter based mail manifesting system and, in particular, relates to one such system having an inserter controller that processes sensed information and generates a document based on at least some of the sensed information.

As generally known, in addition to stamped, labeled and metered mail, the United States Postal Service provides for the payment for postal services by the issuance of permits. In general, because of the economics, permits are typically used only by mailers of large volumes of mail. Essentially, in this type of payment system, a permit holder will prepare a mailing that usually includes a large volume of mail pieces. The entire volume of mail pieces is then presented to the Post Office along with a document that sets forth various details definitive of the contents of the volume of mail pieces. Typically, the document, sometimes referred to as a manifest, a statement sheet, a 3602 or the like, includes such items as the amount of postage due and payable for the mail pieces within the mailing, the total number of pieces, the class and number of mail pieces within each class, and various other documentary facts that enable the postal service to verify that the appropriate postage for the volume of mail is, in fact, properly accounted for and paid. The USPS regulation relating to use of a permit, impose numerous responsibilities on the permit holder. For example, all mail from a particular permittee must be presented to a specific designated postal receiving station. In addition, the permittee is required to set forth, on the document accompanying each volume of mail, certain requisite information as mentioned above.

Quite frequently the document accompanying the mail is substantially completely manually prepared prior to the submission of the associated mail to the designated postal receiving station. Clearly, such a system is fraught with possibilities and opportunity for the commission of mail fraud by dishonest permittees. Further, there also exists tremendous possibilities for human errors to occur in the preparation and documentation shown on a manifest.

Some automated high volume manifest mail systems do exist, however, such as, for example, the systems shown and described in copending U.S. Pat. application Ser. Nos. 813,459, now U.S. Pat. No. 4,760,532 issued July 22, 1988, U.S. Pat. Nos. 813,443, 813,447 now U.S. Pat. No. 4,780,828 issued Oct. 25, 1988 and U.S. Pat. No. 813,445 all filed on Dec. 26, 1985 and assigned to the assignee hereof and incorporated herein by reference. The systems described and discussed therein usually provide, inter alia, for the control and/or transfer of postal value. However, in some instances, the security and accounting features of such a system provided to protect the postal value representative of postage funds may not be thought needed by a particular high volume mail permit user.

Hence, since most high volume mailers utilize some automated procedures and equipment that typically includes, inter alia, the placing of inserts within envelopes, it is highly desirable to provide a mail manifesting system that is substantially completely automated with respect to the generation of a manifest and controlled by an inserter based controller.

SUMMARY OF THE INVENTION

Accordingly, it is one object of the present invention to provide an inserter based mail manifesting system that provides for the production of a manifest.

This object is accomplished, at least in part, by the provision of an insertion apparatus having a controller that receives sensed information and generates a manifest based on at least some of the sensed information.

Other objects and advantages will become apparent to those skilled in the art from the following detailed description of the invention read in conjunction with the appended claims and the drawings attached hereto.

DETAILED DESCRIPTION OF THE INVENTION

Figure 1:
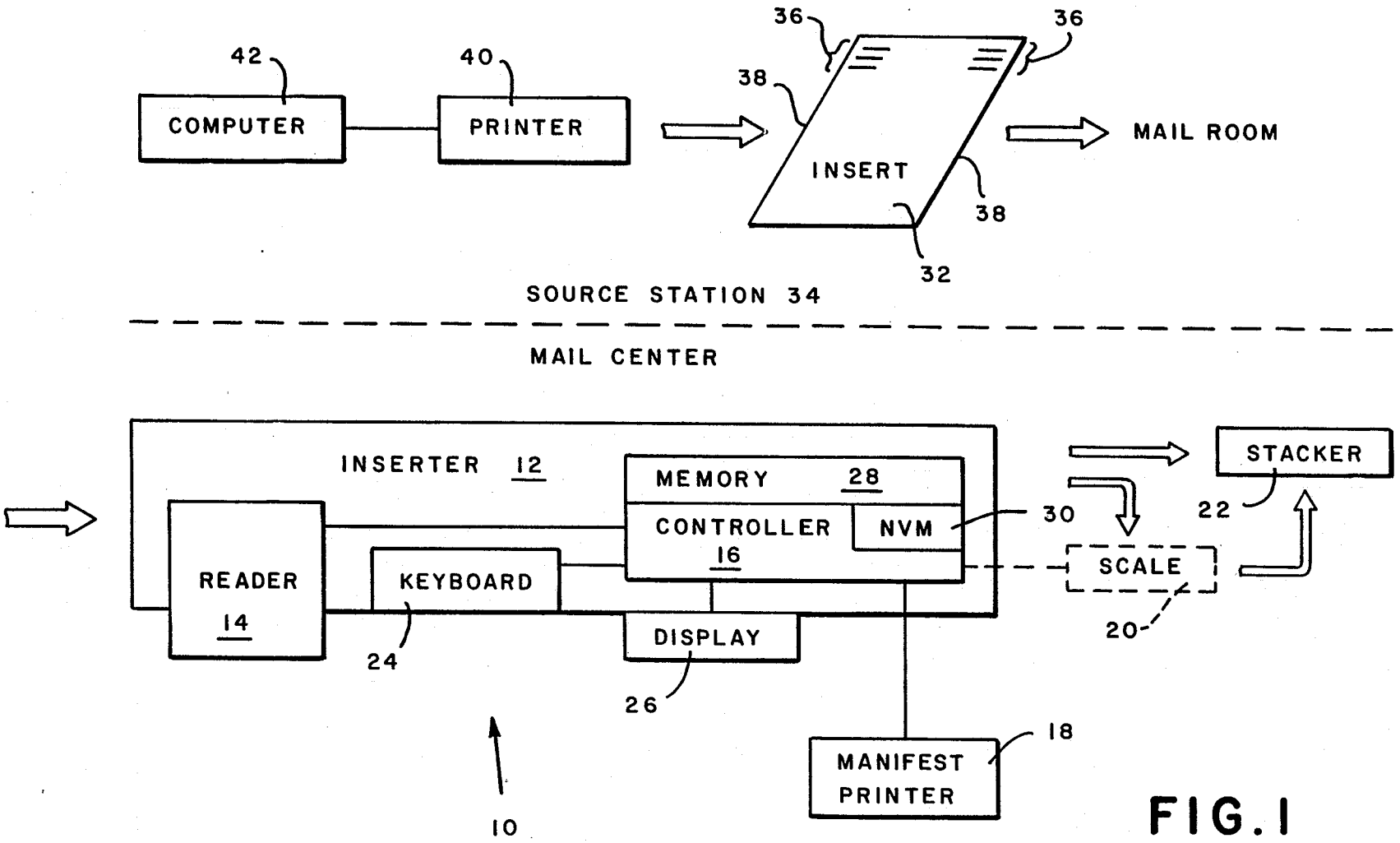
FIG. 1 is a block diagram of an inserter based mail manifesting system embodying the principles of the present invention.

An inserter based mail manifest system, generally indicated at 10 in the Figures and embodying the principles of the present invention, includes an inserter 12 having a reader 14 and a controller 16. The system 10 also includes a printer 18, the printer 18 being in communication with and controlled by the controller 16 of the inserter 12.

In one preferred embodiment, the system 10 additionally includes a scale 20 adapted to communicate with the controller 16 of the inserter 12 and further includes a stacker 22 for receiving the mail pieces outputted by the inserter 12.

In the embodiment shown in FIG. 1, the inserter 12 further includes a keyboard 24 for inputting information into the controller 16 thereof and a display 26 for displaying information.

In one specific implementation, the inserter 12 can be a modified inserter that is similar to the Model 3100 Series High Speed Inserter manufactured and marketed by Pitney Bowes Inc., Stamford, Conn.

Preferably, the inserter controller 16 includes a memory 28, the memory 28 can either be a ROM, a RAM, or both, and a nonvolatile memory 30. The memory 28, preferably, stores programs and/or instructions for initializing the operation of the controller 16. In addition, in the preferred embodiment, the memory 28 is used to store real-time data relating to the ongoing operation of the system 10. The nonvolatile memory 30, as more fully discussed below, preferably includes postal rate tables that can be updated or otherwise modified via the keyboard 24.

In one particular mode of operation, the system 10 receives mail inserts 32 from a source station 34. In many instances, the source station 34 will be a data processing center, however, it could also be any source of document generation. Nonetheless, in such a system 10, the insert 32 is provided with machine readable information, such as, for example, dash codes 36 that, preferably, are imprinted proximate one or more edges 38 thereof by a dash code printing means 40. Usually, the dash code printer 40 is under the control of an information processing device 42, such as, for example, a computer, a word processor or the like. Nonetheless, in the embodiment utilizing dash codes 36, the concern is not so much how they are applied but instead that they are carried by the insert 32 when the insert 32 reaches the inserter 12. Preferably, the information represented by the dash code 36 contains at least the zip code information relating to the address of the intended recipient. Hence, in the instance where each insert 32 is inserted into a different envelope, each insert 32 carries the desired zip code information. In the instance where multiple inserts 32 are inserted into each envelope, it may only be necessary for one of the inserts 32 to carry the information thereon.

The insert 32 carrying the dash coded information, subsequent to the generation thereof, reaches a mail room or mail processing center and is provided to the inserter 12 for insertion thereby into envelopes. If desired the envelopes can be provided with serialized numbers that can be applied by known techniques. Further, in one embodiment, the serial number can be read by the reader 14 such that the serial numbers are available for printing on the manifest.

In the present system 10, the dash codes 36 are read by the reader 14 of the inserter 12. The reader 14 may be one of the relatively well known optical character readers, although any device that can detect the dash code information and store and/or forward that information to the controller 16 can be used. The controller 16 of the inserter 12 then processes the mail in conjunction with the information provided thereto via the reader 14 as well as other information stored by the controller 16. The controller 16 then formats the information relating to each run and commands the printer 18 to print out a manifest of the type and form that is acceptable to the mail service provider. The manifest can thus accompany the volume of mail to the postal service depository whereat the fee required for the mailing can be paid and the contents of the mailing verified against the information on the manifest.

The above description of the system 10 assumes that the mail run includes mail pieces of a single standard weight. As well known, such is not always the case. If the weight information is not available at the time the inserts 32 are generated, and therefore cannot be part of the dash coded information carried thereby, a scale 20 can be provided at the output of the inserter 12 whereat each mail piece is weighed prior to being sent to the stacker 22. The scale 20 then provides information relating to the weight of each mail piece to the controller 16 and the rate or postage for each piece can be determined by the rate/weight table, preferably, stored in the nonvolatile memory 30 of the controller 16. Preferably, the scale 20 is adapted to weigh each mail piece as the mail piece moves thereacross. One such scale that can be adapted for such use is the HAWK Model A120 scale, manufactured and marketed by Pitney Bowes Inc., Stamford, Conn. Alternatively, other weight dependent determining means can be implemented in place of a scale. For example, the postage can be determined by a knowledge of the number and/or type of inserts to be provided and that information can be used in conjunction with related information stored in the controller 16. One particular scheme that is adaptable for use herein is fully described and discussed in copending U.S. Pat. application Ser. No. 010,260 filed on Feb. 2, 1987 and assigned to the assignee hereof. This application is deemed incorporated herein by reference.

Figure 2:
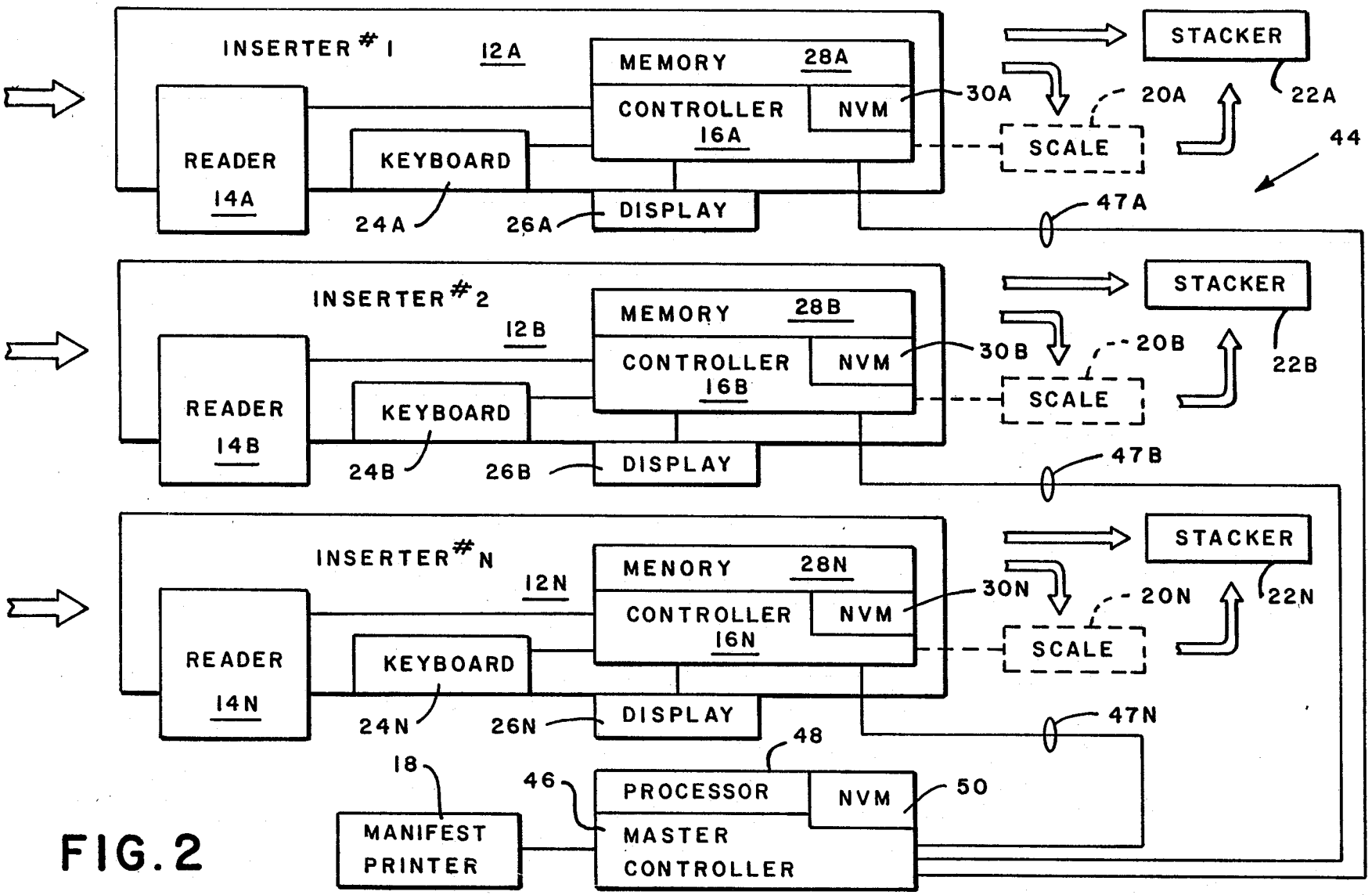
FIG. 2 is a block diagram another inserter based mail manifest system also embodying the principles of the present invention.

Another inserter based mail manifest system 44, also embodying the principles of the present invention, is shown in FIG. 2 wherein the reference numbers used therein designating the various elements thereof are identical to those used with regard to the same elements of the previously described system 10 shown in FIG. 1.

The system 44, as shown in FIG. 2, includes a plurality of inserters, 12*a* . . . 12*n*, each having an optical character reader, 14*a* . . . 14*n*, respectively, and each having an independent controller, 16*a* . . . 16*n*, respectively. Each inserter, 12*a* . . . 12*n*, processes mail pieces in accordance with the above description relating to the system 10 shown in FIG. 1. In addition, however, each inserter, 12*a* . . . 12*n*, shown in FIG. 2 interconnects with a master controller 46 via communication links 47*a*, 47*b* . . . 47*n*, respectively. Preferably, the master controller 46 includes a data processing device 48, such as, for example, a computer. The data processing device 48 of the master controller 46 is adapted to accumulate information from the plurality of inserters, 12*a* . . . 12*n*, and, in conjunction with that information, generate a manifest via the manifest printer 18. As one alternative, the nonvolatile memories, 30*a* . . . 30*n*, of each inserter, 12*a* . . . 12*n*, respectively, can, of course, be eliminated and the weight/rate tables can be centrally located in the nonvolatile memory 50 of the master controller 46.

The systems, 10 and 44, described herein are quite advantageous since such systems, 10 and 44, do not require the security features usually found in systems or devices incorporating the storage and/or transfer of postal value. As a result, the user of the above described systems, 10 and 44, need only deliver mail along with the associated manifest to the postal depository and, after verification by the postal service, pay the required fees due on the mail presented.

Although the present system has been generally described with respect to specific embodiments, it will be understood that other arrangements or configurations may be developed that nevertheless do not depart from the spirit and scope of the present invention. Hence, the present invention is deemed limited only by the appended claims and the reasonable interpretation thereof.

What is claimed is:

1. A system for processing a batch of mail, said system comprising:

an inserter, said inserter including a controller, said controller including means for storing rate information, said rate storing means being nonvolatile;

means for sensing information in the form of dash code from a document, said information including at least a zip code of the intended recipient of said document, said sensing means being in communication with said controller of said inserter;

means for changing said stored rate information; and means for printing a manifest, said manifest printing means being controlled by said controller of said inserter such that a manifest can be printed based on some of said sensed information.

2. The system as claimed in claim 1 further comprises:

means, independent of said information sensing means, for inputting information to said controller of said inserter.

3. The system as claimed in claim 1 further comprises:

means, communicating with said controller of said inserter, for displaying information.

4. The system as claimed in claim 1 further comprising means for storing real time information.

5. The system as claimed in claim 1 wherein said information sensing means includes an optical character reader.

6. The system as claimed in claim 1 further comprises:

means for determining the weight of a mail piece, said weight determining means being in communication with said controller of said inserter such that mail piece weight information can be communicated thereto.

7. The system as claimed in claim 6 wherein said mail piece weight determining means includes a scale, said scale being in communication with said controller.

8. A system for processing mail, said system comprising:

a plurality of inserters, each said inserter including a controller, each said controller including means for storing rate information, each said rate storing means being non-volatile, said controllers being connected to a master controller;

means, associated with each said inserter, for sensing information in the form of dash code from documents provided thereto, each said information including at least a zip code of the intended recipient of said document, said sensing means being in communication with said controller of said associated inserter;

means for changing said stored rate information; and means, in communication with said master controller, for printing a manifest such that a manifest can be printed based on some of said sensed information from said information sensing means.

9. The system as claimed in claim 8 further comprises:

means, independent of said information sensing means, for inputting information to said controller of said inserter.

10. The system as claimed in claim 8 further comprises:

means, communicating with said controller of said inserter, for displaying information.

11. The system as claimed in claim 8 further comprising means for storing real time information.

12. The system as claimed in claim 8 wherein each said information sensing means includes an optical character reader.

13. The system as claimed in claim 8 further comprises:

means, communicating with at least one of said controllers, for determining the weight of a mail piece, such that mail piece weight information can be communicated to said controller.

14. The system as claimed in claim 13 wherein said mail piece weight determining means includes a scale, said scale being in communication with said controller.

* * * * *